United States Patent [19]

Iwahashi et al.

[11] Patent Number: 4,797,707

[45] Date of Patent: Jan. 10, 1989

[54] IMAGE FORMING APPARATUS

[75] Inventors: Haruo Iwahashi; Kazuhiro Nakazawa, both of Hachioji, Japan

[73] Assignee: Konica Corporation, Tokyo, Japan

[21] Appl. No.: 135,359

[22] Filed: Dec. 21, 1987

[30] Foreign Application Priority Data

Dec. 23, 1986 [JP] Japan ..... 61-305291

[51] Int. Cl.[4] ..... G03G 15/00

[52] U.S. Cl. ..... 355/14 R; 355/14 FU; 355/3 DR

[58] Field of Search ..... 355/14 R, 3 R, 14 FU, 355/3 FU, 3 DR, 14 C, 14 CU

[56] References Cited

U.S. PATENT DOCUMENTS 4,551,000 11/1985 Kanemitsu et al. ..... 355/3 DR X
4,563,079 1/1986 Inuzuka et al. ..... 355/14 R
4,618,247 10/1986 Tsuji ..... 355/14 FU
4,627,714 12/1986 Nozaki ..... 355/14 FU
4,739,367 4/1988 Watanabe et al. ..... 355/3 DR X
4,751,484 6/1988 Matsumoto et al. ..... 355/14 CU

*Primary Examiner*—A. C. Prescott
*Attorney, Agent, or Firm*—Finnegan, Henderson, Farabow, Garrett, & Dunner

[57] ABSTRACT

Present invention provides an image forming apparatus wherein a photosensitive member is subjected to optimum fatigue treatment in order to prevent the fluctuation of copying density and prevent fogging. Therefore, an image forming apparatus according to the invention is arranged so that the duration of prerotation for subjecting a photosensitive member to the fatigue treatment in advance is regulated in accordance with both the rest time after the completion of a previously-executed copying operation and the current temperature of the photosensitive member.

9 Claims, 3 Drawing Sheets

IMAGE FORMING APPARATUS

BACKGROUND OF THE INVENTION

The present invention relates to an image forming apparatus designed so that a photosensitive member is subjected to fatigue treatment advance of the copying operation.

In a copying apparatus which has a high-sensitivity photosensitive member capable of establishing electric potential thereon by being subjected to electrification, it may be known in the art that the charge-establishing property of the photosensitive member somewhat changes with respect to operation time period and saturates within an allowable range of steady operating condition. After stopping the copying apparatus, the photosensitive member recover the changed charge-establishing property with respect to rest time period.

As one example of the charge-establishing property, a photosensitive member having a fatigue characteristic will be explained in which the charge establishing property deteriorates or lowers somewhat with respect to operation time period and the lowered charge establishing property due to running fatigue recovers with respect to rest time period. Accordingly, with a long time duration between a copying operation and the next copying operation, the photosensitive member recovers from fatigue, thus causing fogging and an increase in copying density. In order to prevent this problem, a photosensitive member is subjected to fatigue treatment in advance of the copying operation of the copying apparatus.

For example, in order to subject a photosensitive member to fatigue treatment, an apparatus disclosed in Japanese Patent Publication Open to Public Inspection (hereinafter referred to as Japanese Patent O.P.I. Publication) No. 102862/1981 repeats dozens of times, the electrifying, exposing, and neutralizing operations toward a photosensitive member of ZnO during a warming-up of the fixing heater. Another apparatus disclosed in Japanese Patent Examined Publication No. 52428/1984 is so designed that a photosensitive member is prerotated an increased or decreased number of times in proportion to the rest time, i.e. the time which has passed without performing copy operation since turning on the power under the inhibition of the copying operation, so that the uniform imagewise exposure is performed in the area between an electrifying unit and a developing unit. Another apparatus, disclosed in Japanese Patent O.P.I. Publication No. 25752/1981, is so designed that a photosensitive member is irradiated with neutralizing light, exposure light, or the like during a warming-up of the fixing heater.

However, into any of the above mentioned apparatus, such considerations are not incorporated as to the temperature of photosensitive member, nor the dead time after turning the power off to turning the power on again. Further, into the apparatus disclosed in Japanese Patent O.P.I. Publications No. 102862/1981 and No. 25752/1981, such considerations are not incorporated as to the recovery of a photosensitive member from fatigue due to the rest time after the completion of warming-up i.e. the rest time after the first subjection of fatigue treatment until the start of the actual copying operation, nor the recovery of a similar member from fatigue due to the passage of time during a long idling period i.e. the rest time period which has passed while maintaining power on without the copying operation.

Therefore, none of the above mentioned apparatus are adequate, especially regarding the proper control of the image density for a certain number of copying sheets at the start of the image forming operation, to obtain a satisfactory image without causing fogging and an increase in copying density.

SUMMARY OF THE INVENTION

The object of the invention is to provide an image forming apparatus wherein a photosensitive member is subjected to optimum fatigue treatment in order to prevent the fluctuation of copying density and to prevent fogging.

Therefore, an image forming apparatus according to the present invention is arranged so that the duration of the prerotation for subjecting a photosensitive member to fatigue treatment in advance is regulated in accordance with both the rest time after the completion of a previously-executed copying operation and the current temperature of the photosensitive member.

DETAILED DESCRIPTION OF THE INVENTION

Figure 1:
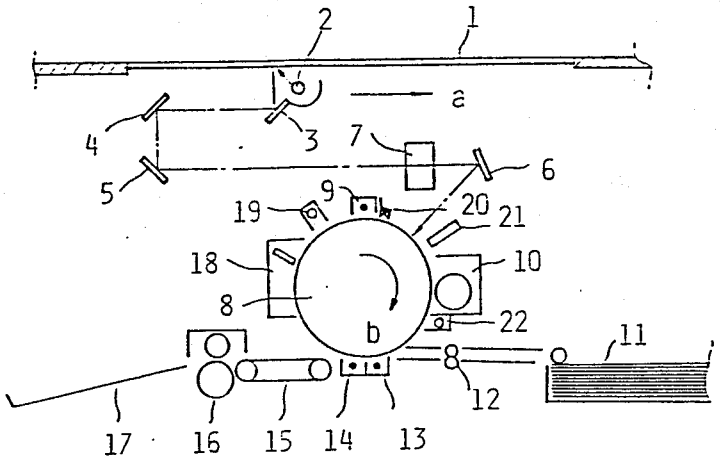
FIG. 1 is a schematic diagram showing the general constitution of a copying apparatus according to the present invention.

One example of an image forming apparatus according to the invention is described below. FIG. 1 is a schematic diagram showing the general constitution of a copying apparatus according to the invention, wherein a document placed on a platen glass 1 is subjected to imagewise exposure with a light source 2 moving in the direction of an arrow a, whereby the image of the document is scanned. Then, the image light generated through the imagewise exposure is guided to the surface of a photoconductive and photosensitive drum 8 via mirrors 3 through 6 and a lens 7. The photosensitive drum 8 is electrified in advance by an electrification electrode 9 and rotates in the direction of an arrow b. When the electrified portion of the photosensitive drum 8 is exposed to the image light, an electrostatic latent image corresponding to the document image is formed onto the portion. Further, where the portion having the latent image has reached a developing unit 10, the toner is attracted onto the portion to form a toner image. At the same time, synchronized with the leading edge of the toner image formed onto the photosensitive drum 8, an image transfer sheet having been fed from a paper feeder unit 11 is transported by a registration roller 12 toward the drum 8. Sequentially, the toner image is transferred onto the sheet by a transfer electrode 13, and the sheet having the toner image is separated from the drum 8 by a separation electrode 14. Further, the sheet is conveyed by a conveyor belt 15 to a portion of a fixing roller 16 so as to be subjected to heat fixing, and is then ejected onto a paper ejection tray.

Numeral 18 represents a cleaning unit to remove toner remaining after a toner image has been transferred onto an image transfer sheet; numeral 19, a pre-electrification exposure (neutralizer); numeral 20, a thermo sensor to detect the temperature of the photosensitive drum 0; numeral 21, a neutralizing lamp capable of selectively neutralizing unnecessary electrical charges on the specific areas of the electrified photosensitive drum 8; numeral 22, a pre-transfer exposure (neutralizer) disposed in the processing area between the developing portion and the transfer portion.

With this example, the image forming apparatus was so designed that the prerotation was provided through the following process: The electrification electrode 9, transfer electrode 13, and separation electrode 14 were provided with a specified voltage, and the exposures involving the light source 3, pre-electrification exposure 19 and pre-transfer exposure 22 were turned on while idly rotating the photosensitive drum 8.

Incidentally, while in this example the above devices were used as means for subjecting a photosensitive member to fatigue treatment during the prerotation of the photosensitive member, it is also possible either to provide an independent means for exerting fatigue treatment or to arbitrarily combine any of the above devices. For this arrangement, the number (duration) of the prerotation of a photosensitive member must be regulated in consideration of the properties of the photosensitive member in order to obtain an optimum regulation.

Figure 2:
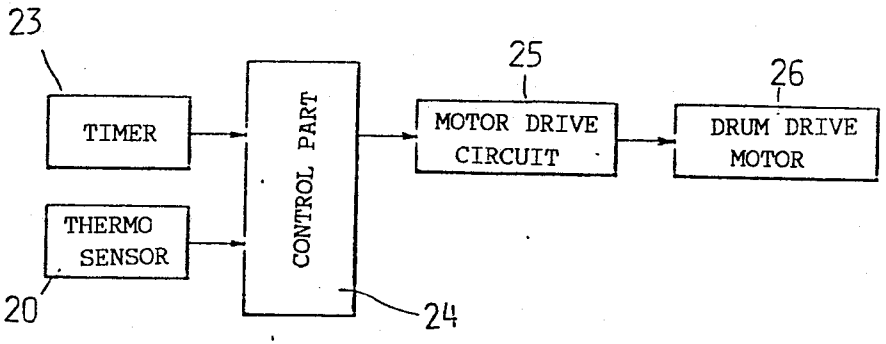
FIG. 2 is a block diagram of a control circuit for controlling the prerotation of a photosensitive member.

Therefore, with this example, as shown in FIG. 2, the image forming apparatus was so arranged that the above prerotation was regulated with a control circuit 24 based on both temperature data from the previously-mentioned thermo sensor 20 and rest time data from a timer 23 for counting rest time. In FIG. 2, numeral 25 represents a motor driving circuit and numeral 26 represents a motor for driving the photosensitive drum 8.

Incidentally, with the photosensitive drum 8 including a photosensitive layer of $As_2Se_3$, the intermittent copying operations were executed at a line speed of 240 mm/sec without the above prerotation. In this case, when the temperature of the photosensitive member was less than 15° C. and when the rest time was more than four hours, the copying density somewhat increased. On the other hand, when the temperature of the photosensitive member was more than 30° C., even if the rest time was approximately one hour, the fatigue quickly recovered and the copying density increased. In either of the two cases, when the rest time had exceeded 12 hours, the fatigue was thought to be fully recovered, and accordingly fogging was caused.

Figure 3:
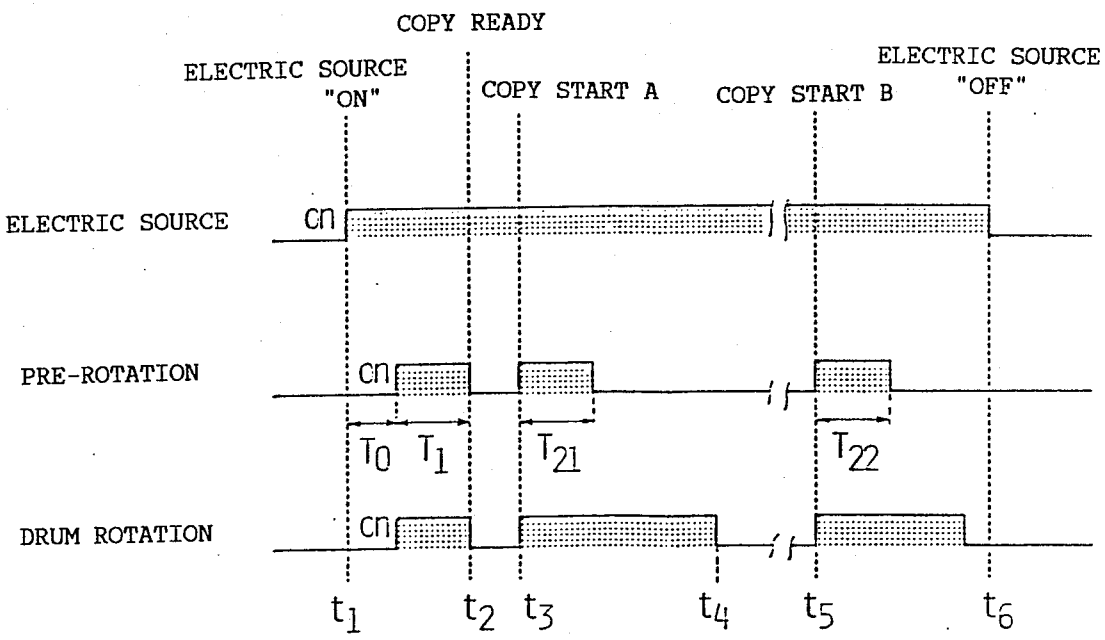
FIG. 3 is a timing chart of the prerotation.

Therefore, with this example, the photosenstive drum 8 was subjected in advance to fatigue treatment by executing the prerotation in correspondence with each timing shown in FIG. 3. In this case, the same drum 8 was subjected to the fatigue treatment by the following process: The first prerotation began when a specified time $T_0$ had passed after having turned the power on at the time $t_1$ and continued for a time $T_1$ until a COPY READY indicator was turned on, i.e. the warming-up was completed at the time $t_2$. Further, another prerotation was executed immediately after the copying operation had begun at each time of $t_3$ and $t_5$ and continued for a timer $T_{21}$ or $T_{22}$ until reaching the image forming stage.

Additionally, such an arrangement was provided that either when the prerotation was executed during the warming-up conducted immediately after turning on the power or when the prerotation was executed immedaitely after the start of the copying operation, the duration of prerotation (time $T_1$, $T_{21}$, or $T_{22}$) was properly regulated in accordance with both the rest time until the start of prerotation and the temperature of the photosensitive member at the start of prerotation. The following table 1 lists the number of the prerotation times which ware executed during the warming-up conducted immedaitely after turning on the power i.e. the first mode to exert fatigue treatment in advance (roughly-estimated time $T_1$). The following table 2 lists the number of prerotation times which were executed immediately after the copying operation begun, i.e. the second mode to exert fatigue treatment in advance (roughly-estimated time $T_{21}$ or $T_{22}$).

TABLE 1

| Temperature of photosensitive member/rest time | Less than 12 hours | 12 through 36 hours | More than 36 hours |
|---|---|---|---|
| Lower than 15° C. | None | None | Twice |
| 15 through 30° C. | None | Twice | 5 times |
| Higher than 30° C. | 5 times | 5 times | 10 times |

TABLE 2

| Temperature of photosensitive member/rest time | Less than 1 hour | 1 through 4 hours | More than 4 hours |
|---|---|---|---|
| Lower than 15° C. | None | None | Once |
| 15 through 30° C. | None | Once | Twice |
| Higher than 30° C. | Once | Twice | 3 times |

With this example, as shown in the above tables, either in the first mode or the second mode to exert fatigue in advance, the number of prerotation times were regulated in accordance with the temperature of the photosensitive member and the rest time, thus preventing fogging. Additionally, in the case of sequential image forming operations, the fluctuation (dispersion) in copying density relative to the image density of the document between the first copying sheet and the 1000th sheet of copying was suppressed to 0.20 (measured with a Sakura reflective densitometer manufactured by Konica Corporation).

Incidentally, with this example, the number of prerotation times of the photosensitive member were varied, while, by regulating the line speed of the photosensitive member, it is also possible to obtain the same effects as in the case of regulating the number of prerotation times. However, it is preferable to regulate the number of prerotation times because of a simpler constitution and easier control.

Additionally, as a means for measuring the rest time during which the photosensitive member is inactive following the completion of the image forming operation, more specifically, the rest time after having turned the power off until again turning the power on, it is, needless to say, adequate and preferable to use a timer. However, it is possible to roughly estimate the time from turning the power off until again turning the power on, based on the surface temperature of the fixing roller at the time the power is turned on. Further, the surface temperature of the fixing roller can be measured by a temperature measuring member which is commonly disposed on the fixing roller in order to regulate the temperature of the fixing roller. In this case, when a long period has passed after turning off the power, the estimation may be difficult and accordingly the prerotation of the photosensitive member is uniformly controlled. However, for example, when the surface temperature of the fixing roller is 200° C. at the completion of warming-up, it is possible to vary the number of prerotation times of the photosensitive member, by detecting whether or not the surface temperature is higher than 160° C. or lower than 160° C. at the time the power is turned on.

Judging from the above-mentioned results, according to the present invention, by determining the time of the prerotation of the photosensitive member in accordance with the rest time and the temperature of the photosensitive member so as to control the amount of fatigue to be subjected, it is possible to properly exert subject fatigue and to obtain a copied image at a proper temperature without causing fogging. Additionally, if the prerotation is provided under the proper control both during the warming-up and immediately after a copying start button is turned on, more specifically, before the image forming operation begins, more satisfactory results will be obtained under the control.

What is claimed is:

1. Image forming apparatus comprising a photosensitive member being rotatable for forming latent image thereon, said photosensitive member having an electric capability of establishing electric potential thereon by being subjected to electrification and having a fatigue characteristic in which the electric capability changes with respect to operation period and the changed electric capability recovers with respect to rest time period, a means for judging the rest time period, a means for detecting temperature of said photosensitve member, a means for providing fatigue to said photosensitive member in order to change the electric capability, a means for controlling said fatigue providing means based on the rest period and the temperature.

2. The apparatus of claim 1, wherein said controlling means preliminary rotates said photosensitve member while actuating said fatigue providing means in advance of image forming operation.

3. The apparatus of claim 2, wherein said controlling means controls the number of prerotation times of said photosensitive member.

4. The apparatus of claim 2, wherein said controlling means controls the prerotation period of said photosensitve member.

5. The apparatus of claim 2, wherein said controlling means has at least two control modes of which, on the first mode, the prerotation of said photosensitive member is carried out after turning on power source of said image forming apparatus before indicating copy ready information and, on the second mode, the prerotation of said photosensitve member is carried out after receiving image forming order.

6. The apparatus of claim 2, wherein said image forming apparatus further comprises a developing means for obtaining toner image by developing the latent image formed on said photosensitive member, and a fixing means having a heat fixing roller for fixing toner image onto recording-medium, wherein said judging means judges the rest period based on the temperature of said heat fixing roller.

7. The apparatus of claim 6, wherein said controlling means has at least two control modes of which, on the first mode, the prerotation of said photosensitive member is carried out after turning on power source of said image forming apparatus and, on the second mode, the prerotation of said photosensitve member is carried out ater receving image forming order.

8. The apparatus of claim 7, wherein said controlling means controls the first mode in accordance with the rest period judged on the basis of the temperature of said heat fixing roller.

9. Image forming apparatus comprising a photosensitive member being rotatable for forming toner image thereon, a fixing means having a heat fixing roller for fixing toner image onto recording medium, said photosensitive member having an electric capability of establishing electric potential thereon by being subjected to electrification and having a fatigue characteristic in which the electric capability changes with respect to operation period and the changed electric capability recovers with respect to rest time period, a means for providing fatigue to said photosensitive member in order to change the electric capability, a means for judging the rest time period based on the temperature of said heat fixing means, a means for controlling said fatigue providing means based on the rest time period.

* * * * *

UNITED STATES PATENT AND TRADEMARK OFFICE

CERTIFICATE OF CORRECTION

PATENT NO. : 4,797,707

DATED : January 10, 1989

INVENTOR(S) : Haruo Iwahashi et al.

It is certified that error appears in the above-identified patent and that said Letters Patent is hereby corrected as shown below:

Claim 1, Column 5, Line 28, change "photosensitve" to --photosensitive--.

Claim 4, Column 5, Line 44, change "photosensitve" to --photosensitive--.

Signed and Sealed this

Fifteenth Day of August, 1989

*Attest:*

DONALD J. QUIGG

*Attesting Officer*

*Commissioner of Patents and Trademarks*